United States Patent [19]

Jackson et al.

[11] 4,159,669

[45] Jul. 3, 1979

[54] HATCH FOR ARMORED VEHICLES

[75] Inventors: Theodore A. Jackson, Utica; James D. Crabtree, St. Clair Shores, both of Mich.

[73] Assignee: Cadillac Gage Company, Warren, Mich.

[21] Appl. No.: 842,215

[22] Filed: Oct. 14, 1977

[51] Int. Cl.[2] ..... B60J 7/00

[52] U.S. Cl. ..... 89/36 L; 296/137 E

[58] Field of Search ..... 296/137 E, 137 F, 137 H; 89/36 L, 36 H, 40 B

[56] References Cited

U.S. PATENT DOCUMENTS

| | | | |
|---|---|---|---|
| 2,338,309 | 1/1944 | Votypka | 296/137 F |
| 2,853,153 | 9/1958 | Sexton | 89/36 H |
| 4,084,848 | 4/1978 | Cunningham | 296/137 E |

FOREIGN PATENT DOCUMENTS

| | | | |
|---|---|---|---|
| 2245777 | 9/1972 | Fed. Rep. of Germany | 89/36 H |

*Primary Examiner*—Philip Goodman
*Attorney, Agent, or Firm*—Krass & Young

[57] ABSTRACT

A hatch for an armored vehicle having a viewing block integral therewith to be moved with the hatch as the hatch is opened and closed. The hatch is mounted for guided movement on a downwardly sloping surface of the armored vehicle so as to move down and away from the hatch opening to allow viewing from the hatch opening downwardly over the opened hatch. The open and closing guides include a three-point roller guide rail support configured to allow the weight of the hatch to be carried by the rollers after an initial upward movement of the hatch from compressive engagement with a peripheral seal installed about vehicle openings and thence slid downwardly on the guide rails away from the opening. The three-point roller guide rail support provides for effective guidance of the hatch movement throughout its range of opening and closing movements and includes two support arms secured to the hatch interior and extending into the hatch opening carrying two of the rollers and a third roller mounted to a hatch exterior surface guided in a guide rail mounted on the surface of the vehicle. A locking pin arrangement is provided to secure the hatch in the open and closed position, while clamping hooks are utilized to hold the hatch down securely on the peripheral seal. The hatch design is particularly adapted to cover the vehicle driver's station with a two-position driver seat utilized for viewing either through the viewing blocks with the hatch closed or at a higher point with the driver's head positioned through the hatch opening.

17 Claims, 8 Drawing Figures

Fig-1
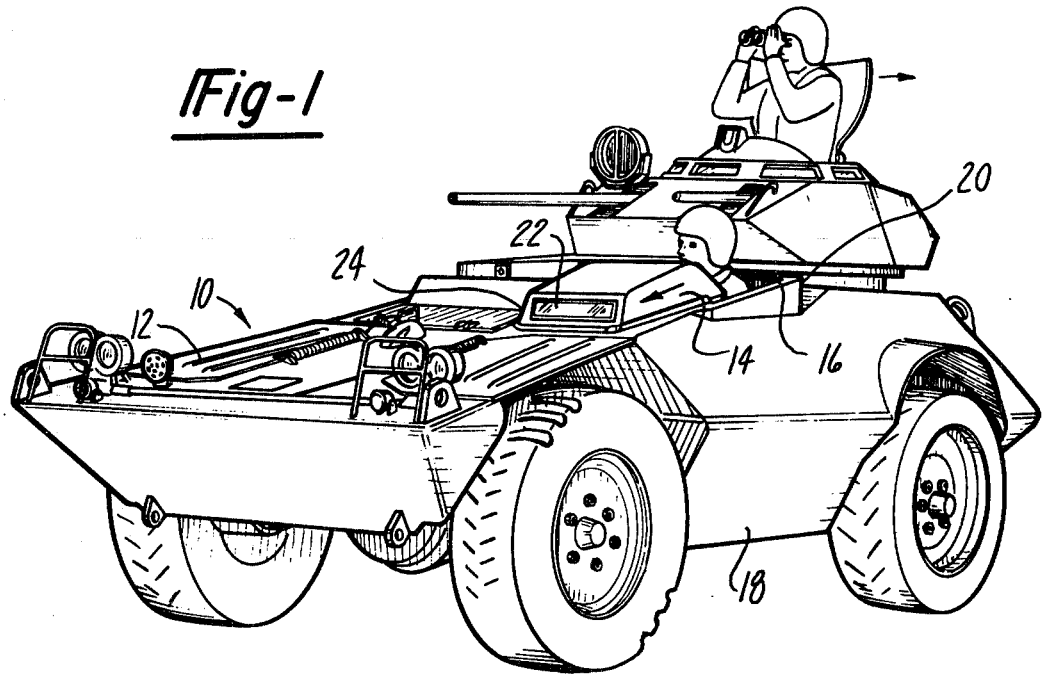
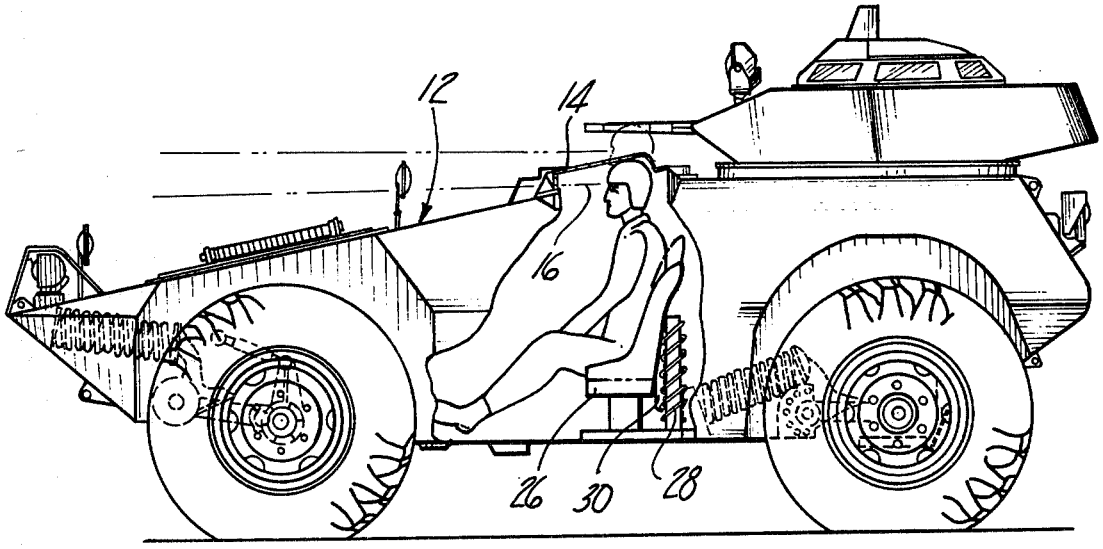
Fig-2

HATCH FOR ARMORED VEHICLES

BACKGROUND DISCUSSION

This invention concerns hatches for providing closures for openings in armored vehicles such as those for the driver's station in tanks and armored cars.

Hatch design for such applications has conventionally provided for a rotation of the hatch laterally away from the opening which it covers or for it to be pivoted backwardly away from the hatch opening. For driver's stations, seperate viewing blocks are usually provided which are installed in appropriate openings formed in the vehicle hull. The viewing blocks provide vision for the driver when the vehicle is being operated in the buttoned up condition, i.e., with the hatch closed. The driver's vision is provided when the hatch is opened by his head protruding through the hatch opening.

This arrangement has been utilized more or less satisfactorily in the past. However, it does tend to create complex designs which are cumbersome to operate since the hatches must be of relatively heavy weight construction since they are often located in the forward portion of the vehicle and accordingly must be adequately resistant to ballistic impact. In some designs, the open hatch presents a vulnerable vertical contour if the vehicle should come under fire with the hatch open. Further, the hatch is cumbersome to operate and may require undue length of time to close and also may require the driver to be exposed in order to close the hatch.

It is accordingly an object of the present invention to provide a hatch design which is relatively simple in design, but which is relatively easily manipulated in opening and closing of the hatch.

It is yet another object of the present invention to provide such a hatch in which the viewing capability is provided in both the open and closed positions.

It is still another object of the present invention to provide a hatch design for armored vehicles which presents relatively oblique surfaces in both the hatch open and closed position and which does not require exposure of the driver in order to close the hatch.

SUMMARY OF THE INVENTION

These and other objects of the present invention, which will become apparent upon a reading of the following specification and claims, are accomplished by a hatch design in which the hatch is formed with an integral viewing block on its leading surface which moves with the hatch as it opens and closes. The hatch moves to open down and away from the hatch opening over an oblique hull surface such that the driver may view over the top of the hatch in the open position. The hatch movement is carried out by a three-point roller guide rail support from the hatch which provides effective guidance of the hatch movement throughout the range of movement of opening and closing the hatch.

The guide rails are configured to provide a camming section which causes the weight of the hatch to be assumed by the rollers when the hatch is initially moved off, taking the weight of a peripheral seal provided about the hatch opening. The hatch is then rolled on the guide rails down and away from the opening.

The three-point support is provided by a pair of interior support arms, each having a roller mounted to its interior end and guided for rolling movement in guide rails mounted within the vehicle interior, and an exterior roller guided in a guide rail mounted to the exterior of the vehicle.

A locking pin is provided which locks the hatch in the open and closed position.

Clamping hooks are provided to retain the hatch securely in engagement with the peripheral seal when the hatch is in the closed position.

BRIEF DESCRIPTION OF THE DRAWINGS

FIG. 1 is a perspective view of an armored vehicle incorporating a hatch arrangement according to the present invention.

FIG. 2 is a side elevational view of the vehicle shown in FIG. 1, shown in partial section to depict the position of the driver with respect to the hatch opening in the hatch open and closed position.

DETAILED DESCRIPTION

Figure 3:
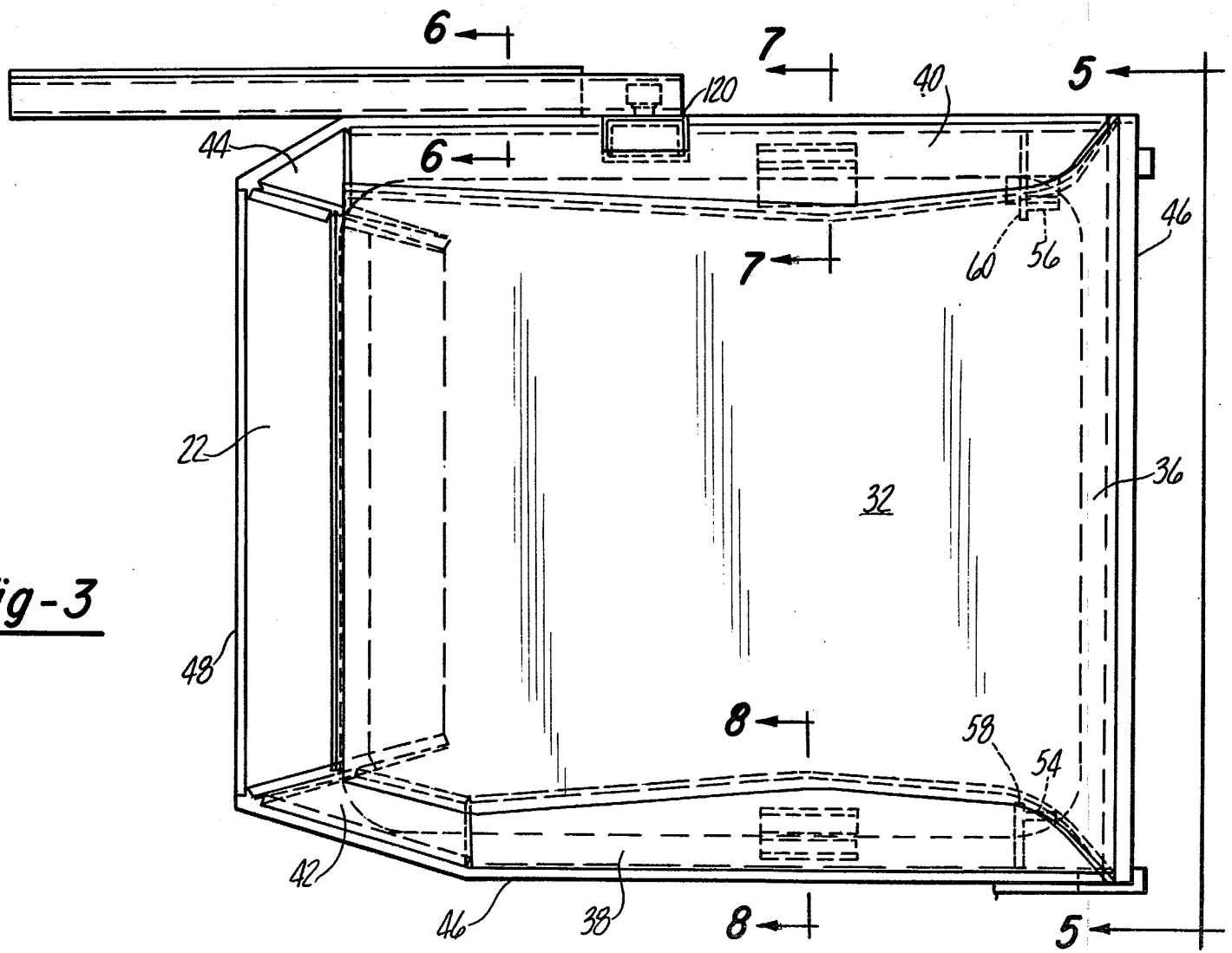
FIG. 3 is a plan view of the hatch and mounting arrangement according to the present invention.

In the following detailed description, certain specific terminology will be utilized for the sake of clarity and a specific embodiment described in accordance with the requirements of 35 USC 112, but it is to be understood that the same is not intended to be limiting and should not be so construed inasmuch as the invention is capable of taking many forms and variations within the scope of the appended claims.

Referring to the drawings, the hatch and mounting arrangement, according to the present invention, has particular application to hatches for driver's stations which are adapted to provide a closure for a hatch opening in the upper hull surface 12 of the armored vehicle 10. More particularly, this hatch is especially adapted to the hull design having a long sloping upper forward surface as described and claimed in copending application Ser. No. 842,214, filed Oct. 14, 1977, attorney docket No. XLO-128.

The upper surface 12 of the armored vehicle 10 is of extended length and slopes obliquely at a relatively shallow angle. The hatch 14 is adapted to provide a closure for the hatch opening 16 formed in the vehicle hull 18. The opening 16 is formed into the hull 18 and may include an appropriate armor plate framing 20 to conform the slant of the opening 16 to the general slope of the upper surface 12 so that the hatch 14 may be moved down and away in a direction along the same oblique angle as the surface 12.

The hatch 14 is formed according to the concept of the present invention with an integral viewing means comprised of a ballistic impact resistant block 22 located in the forward surface 24 of the hatch 14. The viewing block 22 is per se contemplated as being of known design, disposed within an appropriately configured opening in the hatch 14 as per conventional practice in installing and mounting such viewing blocks.

As best seen in FIG. 2, the hatch 14 in moving to the open position is slid down and away from the hatch opening 16 along a direction parallel to the oblique angle of the surface 12 such that the driver, by elevating his seat 26, may view over the top of the hatch 14 when it is in the open position. A two-position seat 26 may be provided with a spring support 28 and guide 30 incorporated to allow the driver to be positioned in a downward position viewing through the view block 22 or in an up position with the hatch 14 open, the driver thus able to view down over the top of hatch 14.

The down and away motion of the hatch provides for the elimination of the hatch 14 as a viewing obstruction even though it is moved forwardly and the hatch 14 in the open position is tilted in conformity with the oblique angle of surface 12 to further aid in viewing over its top.

It can be seen in FIGS. 1 and 2 that the hatch 14, even in the open position, presents a relatively oblique contour and is positioned to afford the driver some protection even in the open position.

Figure 4:
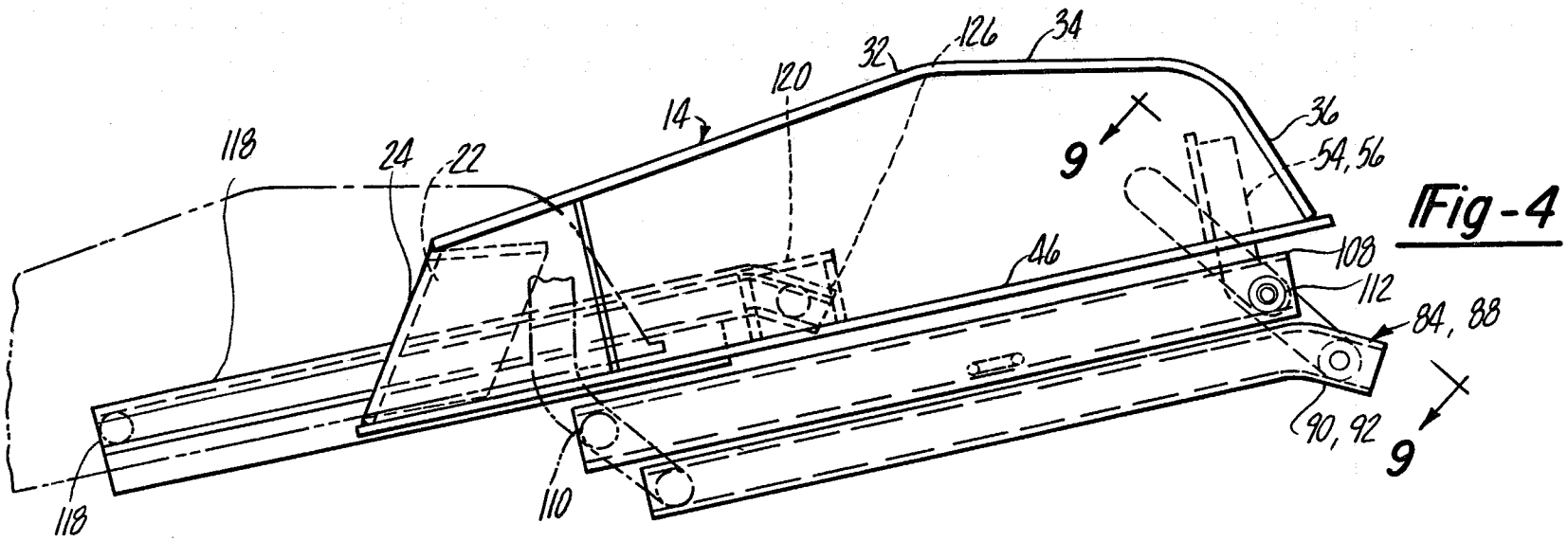
FIG. 4 is a side elevational view of the hatch and mounting arrangement shown in FIG. 3 with the opening movement of the hatch shown in phantom.
Figure 5:
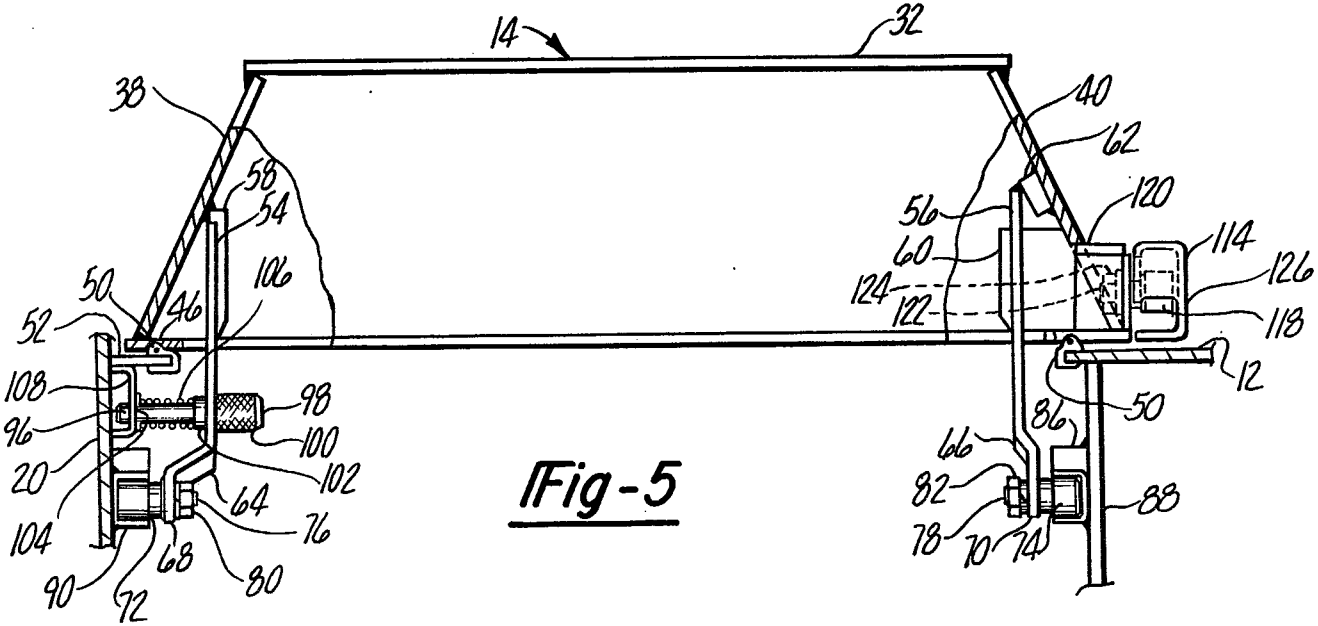
FIG. 5 is a view along the direction of arrows 5—5 in FIG. 3.

The armored vehicle 10, shown in FIGS. 1 and 2, is an armored wheeled vehicle which is generally constructed of armor steel plate welded into a unitary hull. The hatch 14 may similarly be constructed of welded armor plate as shown in FIGS. 4 and 5. The top plate 32 is domed toward the rear portion at 34 in order to provide head room for the driver's head which would be normally positioned in the rear area of the hatch 14 with the upper surface 32 sloping downward to a narrower width at the front in the region of the viewing block 22.

The top plate 32 is formed downwardly to provide a rear surface 36 of the hatch 14. A pair of side plates 38 and 40 are welded to the top plate 32, as well as a pair of inclined transition pieces 42 and 44, which serve to define the openings to receive the vision block 22. A bottom plate 46 is welded to the side plates 38 and 40 of the transition pieces 42 and 44 and a vision block retainer plate 48 which bottom plate 46 extends entirely about the periphery of the hatch 14 to provide a flat bottom surface for mating with the hatch opening peripheral seal 50 shown in FIG. 5.

The peripheral seal 50 is secured about the periphery of the opening 16 by being mounted to a lip 52 welded to the framing 20 and also with the hull plate 12.

The hatch 14 thus forms a dish-shaped structure which is inverted over the opening 16 to accommodate the driver's head during viewing through the vision block 22, with sloping sides extending about the side and rear portions to render the surfaces somewhat more resistant to penetration by projectiles or shrapnel.

The hatch 14 is supported and guided during its opening and closing movements by a cam roller guide rail arrangement comprised by a pair of support arms 54 and 56 located on either side of the hatch which are mounted to the interior of the hatch 14 to side plates 38 and 40, respectively, welded to gussets 58 and 60, respectively, which are in turn welded to the side plates 38 and 40. The upper end of the support arm 54 is welded to the side plate 38 as shown in FIG. 5, while the upper end of the support arm 56 is supported by a welding block 62 welded to the side plate 40. Each support arm 54 and 56 extends downwardly from within the interior of the hatch 14 into the opening 16, passing into the interior of the vehicle 10. The lower ends of the arms 54 and 56 are offset at 64 and 66 with terminal ends 68 and 70 carrying cam rollers 72 and 74. Each of the cam rollers 72 and 74 are supported on a threaded cam shaft 76 and 78, respectively, which in turn are secured to the support arm ends 68 and 70 by nuts 80 and 82.

The cam rollers 72 and 74 are in turn supported and guided by guide rails 84 and 86, respectively, which are secured within the interior of the vehicle 10 with guide rail 84 being welded to the armor plate frame 20 and guide rail 86 welded to an internal partition plate 88.

Each of the guide rails 84 and 86 have a terminal dogleg section 90 and 92 which serve to act as cam means on the cam rollers 72 and 74, causing a slight vertical movement as the hatch 14 is moved forwardly causing the weight of the hatch 14, which had been on the peripheral seal 50, to be assumed by the guide means, lifting the bottom plate 46 off the seal 50. This eliminates rubbing movement on the seal 50 which would tend to dislodge the seal and produce excessive wear on the seal. This also eliminates frictional sliding resistance to movement of the hatch 14. At the same time, the weight of the hatch 14 is utilized to produce good sealing engagement with the peripheral seal 50 in the hatch closed position. Each of the support arms 54 and 56 is located to the rear of the hatch 14 from the direction of opening movement, as shown. Thus, the arms 54 and 56, although extending into the interior of the opening 16, can accommodate a forward opening motion of the hatch 14 since the forward motion is limited to that somewhat less than the overall length of the opening 16.

The support arms 54 and 56 are also inclined to the rear, as seen in FIG. 4, to reduce the forward resistance to rolling motion due to deflection of the support arms 54 and 56.

The support arm 54 also carries a locking pin 96 mounted by means of a threaded end 98 and nut 100. The stop pin 96 passes through a fixed bushing 102 secured to the support arm 54. The stop pin 96 is formed with a shoulder 104 which engages a compression spring 106. A channel 108 is provided which acts as a gusset for the lip 52 and also has a pair of locator holes 110 and 112 (FIG. 4) formed therein which are adapted to receive stop pin 96 in the hatch open and hatch closed positions. The compression spring 106 resists withdrawal of the stop pin 96 by outward pull on the pin handle 94 such as to urge the same back into seating engagement with either locator holes 110 or 112 after the hatch has been opened or closed, respectively.

Figure 6:
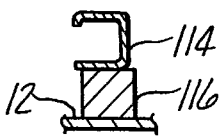
FIG. 6 is a view of the section 6—6 taken in FIG. 3.

To provide a three-point support for the hatch 14 to allow full support for its weight on the guide means and to better control over its opening and closing movement preventing any tilting or cocking of the hatch 14 in the guide rails 90 and 92, a third cam roller and guide rail arrangementis provided on the exterior of the hatch 14. This includes the guide rail 114 which is welded to the support block 116 in turn welded to the outer surface 12 as shown in FIG. 6.

The guide rail 14 receives a cam roller 118 which is mounted to a support box 120 welded to the side plate 40. The cam roller had a stem portion 122 and nut 124 to secure the same to the support box 120. The location of the support box 120 and cam roller 118 is forwardly on the hatch 14 to provide a spaced three-point guidance of the hatch 14 and thus the guide rail 114 extends forwardly of the guide rails 90 and 92 as seen in FIG 4. This allows control of the front portion of the hatch 14 as it moves between the open and closed positions.

The guide rail 118 is similarly provided with a dogleg portion 126 which acts in concert with the dogleg portions 90 and 92 of guide rails 84 and 86 to lift the hatch 14 during the initial opening movement and to lower the hatch 14 during the final closing movement to allow its weight to compress the peripheral seal 50.

Figure 7:
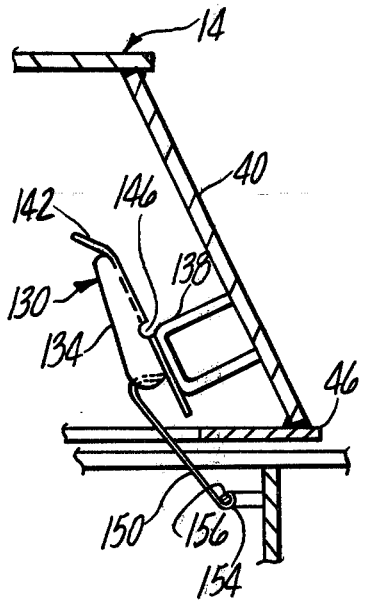
FIG. 7 is a view of the section 7—7 taken in FIG. 3.
Figure 8:
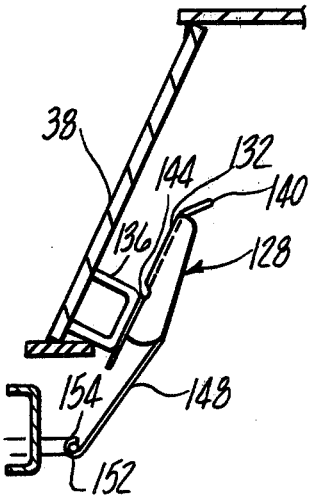
FIG. 8 is a view of the section 8—8 taken in FIG. 3.

In order to clamp the hatch 14 in the closed position securely against the seal, a pair of clamping devices 128 and 130 are provided on either side of the interior of the hatch 14 at approximately the midpoint. Each clamping device includes a clamping arm 132 and 134, respectively, formed of the generally channel shaped formed part of a resilient material such as spring steel. Each clamping arm 132 and 134 is welded to a clamp pad 136 and 138, in turn welded to the side plates 38 and 40. The clamping arms 132 and 134 comprise an outer tab 140 and 142 and a notched out portion 144 and 146 to increase the ability of the clamping arms to be resiliently deflected outwardly by grasping the tabs 140 and 142. Clamp hooks 148 and 150 are welded to the clamping arms 134 and 132 so as to normally extend in a generally horizontal direction so as to be clear of the opening 16, but can be deflected downwardly into the opening in the position shown in FIGS. 7 and 8. The clamp hooks 148 and 150 are formed with hook ends 152 and 154 which are adapted to hook clamp catches 156 and 158, respectively. Upon release of the clamping arms 132 and 134, a downward pressure is exerted on the hatch and catches in order to retain the hatch as the vehicle is under way.

Hook ends 152 and 154 are quickly released by manipulation of the tabs 140 and 142, allowing the hooks to spring outwardly out of the way as the hatch 14 is moved to the open position.

Accordingly, it can be seen that the objects of the present invention have been achieved since the simple down and away motion with the integral vision block has relatively easy opening and closing of the hatch by a simple mechanism with the weight of the hatch being rather easily handled manually because of the inclined plane effect afforded by the sloping movement as the hatch is moved downward and away and up and toward the hatch opening 14.

This, together with the reduction in friction, to a minimum level by the use of a cam roller track arrangement supporting the weight of the hatch through opening and closing movements. A simple one step movement lifting the hatch weight upward from the seal and down onto the seal is afforded by the dogleg track configuration to allow good sealing engagement and without involving the rubbing of the seal surfaces. The integral viewing block and hatch construction allows the configuration to be simpler and enables the front of the hatch to be free from obstruction to make possible the down and away movement of the hatch during opening. The hatch is securely positioned in the open and closed position by the simple expedient of the locking pin which serves to secure the hatch in both the open and closed positions.

Alternative arrangements and applications of the hatch are of course possible. The clamping devices may or may not be required depending on the nature of the seal utilized and the weight of the hatch.

The embodiments of the invention in which an exclusive property or privlege is claimed are defined as follows:

1. A hatch arrangement for armored vehicles for providing a closure for an opening extending into an oblique frontal armored surface of said vehicle, the hatch arrangement comprising:

a hatch configured to provide a closure for said vehicle opening;

means providing for guided movement of said hatch between an open and closed position with respect to said opening, said means including guide means guiding said hatch for movement away from said opening in a frontal direction along said sloping surface down from said opening whereby said hatch is positioned in said open position at an oblique angle corresponding to said oblique frontal surface of said armored vehicle.

2. The hatch arrangement according to claim 1 wherein said hatch further includes integral viewing means located in a leading surface of said hatch whereby when said hatch is in said closed position viewing through said viewing means integral with said hatch is accomodated.

3. The hatch arrangement according to claim 2 wherein said guide means includes means causing the weight of said hatch to be assumed by said guide means upon an initial upward movement of said hatch means as said hatch is moved away from said opening prior to initiating said away movement whereby said hatch is lifted from said vehicle opening initially.

4. The hatch arrangement according to claim 2 wherein said hatch is dished with a greater height rearward from said leading surface whereby viewing through said vision means is aided.

5. The hatch arrangement according to claim 1 wherein said guide means includes a pair of spaced support arms fixed at one end to the interior of said hatch at a rear surface thereof remote from said direction of movement of said hatch moving away from said vehicle opening, and further includes means acting on the other ends of said support arms guiding movement of said hatch moving between said open and closed position.

6. The hatch arrangement according to claim 5 wherein said guide means further comprises rollers rotatably mounted on said other ends of each of said pair of support arms and further including guide rails mounted within said vehicle and adapted to control rolling movement of said rollers along said guide rail, said guide rails extending in said direction of movement of said hatch in moving between said open and closed position.

7. The hatch arrangement according to claim 5 wherein said guide means further includes means acting on said hatch exterior guiding said motion along the direction of motion of said hatch and moving between said open and closed position where by three point support is comprised by said pair of support arms and said means secured to the exterior of said hatch.

8. The hatch arrangement according to claim 6 further including a roller rotationally mounted on the exterior of said hatch and further including a guide rail mounted to the exterior of said vehicle and adapted to engage said roller means mounted on the exterior of said hatch and guide rolling movement thereof along the direction of movement of said hatch moving from between said open and closed position.

9. The hatch arrangement according to claim 3 wherein said hatch arrangement further includes a peripheral seal mounted about said vehicle opening and wherein said hatch is formed with a bottom surface configured to engage said peripheral seal and wherein said guide means during said initial upward movement of said hatch lifts said hatch out of engagement with said peripheral seal during initial opening movement of said hatch and lowering said hatch bottom surface onto said peripheral seal upon final closing movement of said hatch guide means.

10. The hatch arrangement according to claim 1 further including a locking means selectively operable to lock said hatch to said vehicle in said hatch open and closed position, respectively.

11. The hatch arrangement according claim 9 further including clamping means selectively operable to clamp said hatch downwardly with said hatch in said closed position whereby said peripheral seal may be pressed by said clamping means.

12. The hatch arrangement according to claim 6 wherein said rollers are mounted on a portion of said support arms inclined in the direction of movement of said hatch in moving between said open and closed position.

13. The hatch arrangement according to claim 8 wherein said roller mounted to said exterior of said hatch is mounted to said hatch exterior at a point forward of said point whereat said support arms are affixed to said interior of said hatch.

14. The hatch arrangement according to claim 9 wherein said hatch further includes integral viewing means located in a surface of said hatch whereby when said hatch is in said closed position viewing through said viewing means integral with said hatch is accomodated.

15. The hatch arrangement according to claim 6 wherein said hatch further includes integral viewing means located in a surface of said hatch whereby when said hatch is in said closed position viewing through said viewing means integral with said hatch is accomodated.

16. The hatch arrangement according to claim 8 wherein said hatch further includes integral viewing means located in a surface of said hatch whereby when said hatch is in said closed position viewing through said viewing means integral with said hatch is accomodated.

17. A hatch and mounting arrangement for an armored vehicle opening comprising:

a hatch configured to provide a closure for said opening;

means for guiding movement of said hatch between an open and closed position with respect to said vehicle opening;

viewing means integral with said hatch accomodating viewing through said hatch within said vehicle when said hatch is in said closed position.

* * * * *